United States Patent [19]

Hodgkins et al.

[11] Patent Number: 4,971,528

[45] Date of Patent: Nov. 20, 1990

[54] LUBE OIL PUMP WITH RELIEF VALVE

[75] Inventors: David H. Hodgkins, Granby; Leon P. Janik, Suffield, both of Conn.

[73] Assignee: Stanadyne Automotive Corp., Windsor, Conn.

[21] Appl. No.: 319,167

[22] Filed: Mar. 6, 1989

[51] Int. Cl.[5] ..... F04B 17/00

[52] U.S. Cl. ..... 417/310; 418/170

[58] Field of Search ..... 418/170; 417/310, 440

[56] References Cited

U.S. PATENT DOCUMENTS 2,893,323 7/1959 Enemark ..... 418/170

3,021,790 2/1962 Brunson ..... 417/310

FOREIGN PATENT DOCUMENTS 2489894 3/1982 France ..... 418/170

*Primary Examiner*—Leonard E. Smith

*Assistant Examiner*—Robert N. Blackmon

*Attorney, Agent, or Firm*—Chilton, Alix & Van Kirk

[57] ABSTRACT

An oil pump has a split frame with the pump mechanism situated in a chamber in one of the frames or between the split frames. An inlet conduit extends from an inlet port to the low pressure side of the pump and an outlet conduit extends from the high pressure side of the pump to an outlet port. An excess pressure relief path is provided to permit fluid flow from the outlet conduit to the inlet conduit when the outlet conduit pressure exceeds the inlet conduit pressure by a predetermined difference. This is accomplished by providing a bypass channel formed in one frame and fluidly intersecting the outlet conduit, and a valve cavity formed in the other frame and fluidly intersecting the bypass channel and the inlet conduit. Valve means are situated in the valve cavity for isolating the bypass channel from the inlet conduit during normal pressure differences between the inlet and outlet conduits. Upon the occurrence of excess pressure in the outlet conduit, the valve opens to permit fluid flow from the outlet conduit to the inlet conduit.

6 Claims, 2 Drawing Sheets

LUBE OIL PUMP WITH RELIEF VALVE

BACKGROUND OF THE INVENTION

The present invention relates to oil pumps, and more particularly, to a lube oil pump of the type used in internal combustion systems.

One type of lube oil pump used in internal combustion systems is mounted on the engine crank shaft. The body of the pump contains the pump gears or rotors and inlet and outlet ports. A cover plate encloses the pumping mechanism. A low pressure or vacuum inlet conduit extends from an inlet port through the frame into the low pressure, or intake side of the pump chamber, and a high pressure conduit extends from the high pressure, or discharge portion of the pump chamber, to a pump outlet port.

These oil pumps have pressure relief or regulating valves to control engine oil pressure. Such valves generally have a spring-biased piston which uncovers an orifice when overbalanced by oil pressure, creating a variable size relief conduit. Other valving action is commonly provided by placing a spring-biased poppet valve in a bore that leads from a region of high pressure to the inlet. Such a design requires a means for closing and sealing the bore and a means for holding the valve central to the valve seat center line.

SUMMARY OF THE INVENTION

It is an object of the present invention to provide a passively actuated relief valve on a lube oil pump of the type described above, which is easily fabricated, has few moving parts, and, optionally, no external closing or sealing structure.

In accordance with the invention, the oil pump has a split frame with the pump mechanism situated in a chamber in one of the frames or between the split frames. An inlet conduit extends from an inlet port to the low pressure side of the pump and an outlet conduit extends from the high pressure side of the pump to an outlet port. An excess pressure relief path is provided to permit fluid flow from the outlet conduit to the inlet conduit when the outlet conduit pressure exceeds the inlet conduit pressure by a predetermined difference. This is accomplished by providing a bypass channel formed in one frame and fluidly intersecting the outlet conduit, and a valve cavity formed in the other frame and fluidly intersecting the bypass channel and the inlet conduit. Valve means are situated in the valve cavity for isolating the bypass channel from the inlet conduit during normal pressure differences between the inlet and outlet conduits. Upon the occurrence of excess pressure in the outlet conduit, the valve opens to permit fluid flow from the outlet conduit to the inlet conduit.

Preferably, the bypass channel is formed as a cut out in the front of the first frame member, and the valve cavity and inlet port have respective open ends at the rear of the second frame member, the open ends being exposed to the bypass channel. The bypass pressure relief flow passes through the valve cavity to the inlet conduit.

The lube oil pump of the present invention can thus be easily formed in the lower portions of the two frame members, by a combination of straight forward casting operations and the ready placement of a simple, spring biased valve member in one of the cast surfaces, i.e., the valve cavity.

BRIEF DESCRIPTION OF THE DRAWING

These and other objects and advantages of the invention will be described below with reference to the accompanying drawings, in which.

DESCRIPTION OF THE PREFERRED EMBODIMENT

Figure 3:
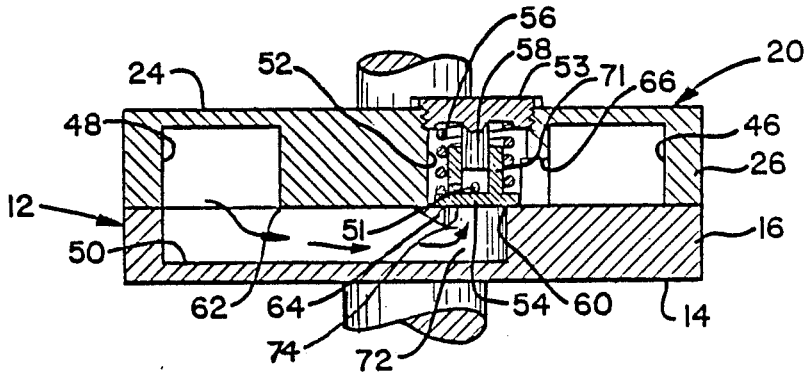
FIG. 3 is a section view through line 3—3 of FIG. 1, showing the relief valve.

The figures show a lube oil pump 10, formed from a first frame member 12 which has a substantially flat front face 14, a substantially solid upper portion 16 and a cut out rear face 18, and a second frame member 20 having a flat or cut out front face 22, a rear face 24, and a substantial solid upper portion 26. The front face 22 of the second frame member 20 sealingly engages the rear face 18 of the first frame member 12, as by bolts, screw, gaskets and the like (not shown), whereby the cut out 17 and surface 19 (which may optionally be cut out), define a pump chamber 28 between the frame members.

Figure 1:
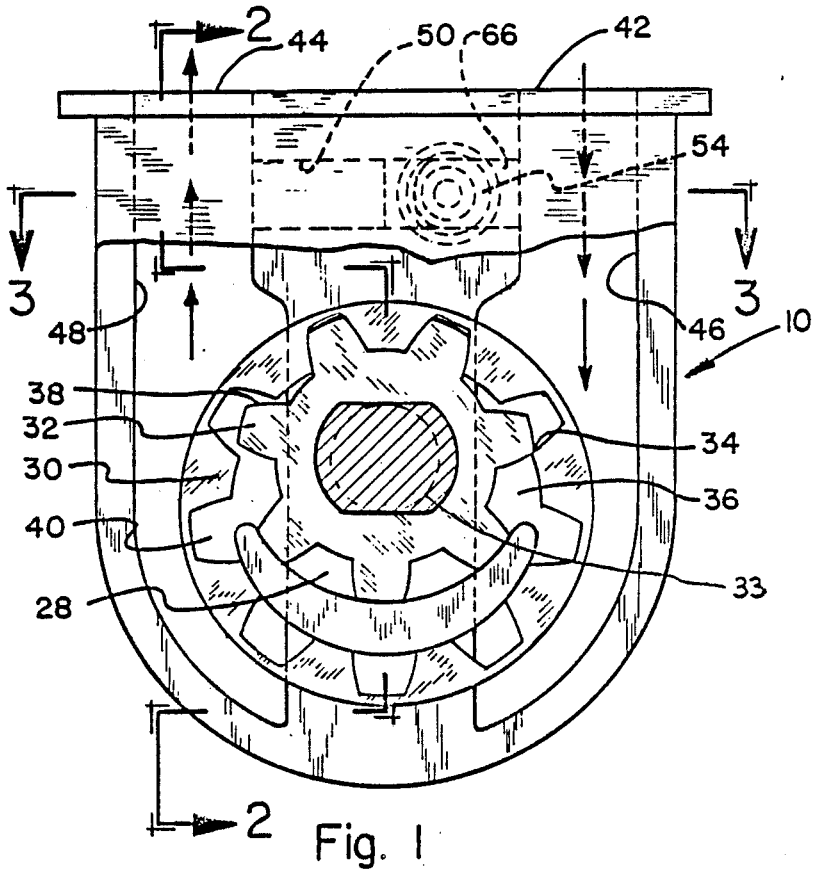
FIG. 1 is a front elevation view of a split frame lube oil pump with relief valve, in accordance with the invention.

A pair of gear members such as outer gear 30 and inner gear 32 are situated within the pump chamber 28 for relative rotation therein. In the illustrated embodiment, the inner gear member 32 is driven by shaft 33 and rotates eccentrically relative to the outer gear 30, such that the respective lobes form a first engaged configuration 34 defining a low pressure pocket 36 on one side of outer gear 30, and a second engaged configuration 38 defining a high pressure pocket 40 at the radially opposite side of the outer gear 30. Different types and configurations of the pumping mechanism, i.e., gear means 30, 32, are known in the art and the present invention is not to be limited to the type shown in FIG. 1.

An inlet port 42 and an outlet port 44 are cast into the upper portions of the second frame member 20. The inlet port 42 is fluidly connected to an inlet conduit 46 which extends vertically within the second frame member to some extent. Conduit 46 leads to a vertically extending, channel portion of the first frame member 12, thus forming an extended, generally vertically oriented flow path from the inlet port 42 in the second frame member 20 to the low pressure pocket 36 in the pump chamber 28. Similarly, an outlet conduit 48 leads from the high pressure pocket 40, through a substantially vertically extending channel in the first frame member, into fluid communication with a vertically extending portion in the front frame member, and then eventually to the outlet port 44.

It should be appreciated that reference herein to first and second frame members, or front and rear faces on the frame members, or upper and lower directions, is somewhat arbitrary. The pump chamber and mounting of the pump gears may optionally be provided in one or the other, or both, of the frame members.

The inlet and outlet ports 42 and 44 are formed in one or the other of the frame members, e.g., only in second frame member 20. The bypass channel 50 is preferably formed in the other of the frame members, e.g., member 12, in fluid communication with a portion of the outlet conduit 48 or outlet port 44. Thus, in general, the inlet and outlet ports 42, 44 are substantially parallel and the inlet and outlet conduits 46, 48 are, over a significant extent, transverse to the pump rotation axis and parallel to each other and to the faces 14, 24 of the frame members 12, 20. The bypass channel 50 extends in parallel to the faces of the frame members, transversely to the pump gear rotation axis, in a horizontal direction from the outlet conduit 48 toward the inlet conduit 46. The bypass channel 50 is preferably cast as a cut out in the rear face 18 of the front frame member 12 above the pump chamber cut out 17.

A valve cavity 52 is bored through or cast into the rear face 24 of the second frame member 20 adjacent to the inlet port 42, between the inlet conduit 46 and the outlet conduit 48. A cover plate 53 can be threaded to rear face 24 to close off cavity 52 and form a seat. Alternatively, cavity 52 can be formed by a partial bore from the front face 22 of second frame member 20, in upper portion 26. The valve cavity 52 and the outlet conduit 48 (or outlet port 44) have respective open ends 60, 62 at the front of the upper portion 26 of the second frame member 20, which are exposed to the bypass channel 50.

Figure 2:
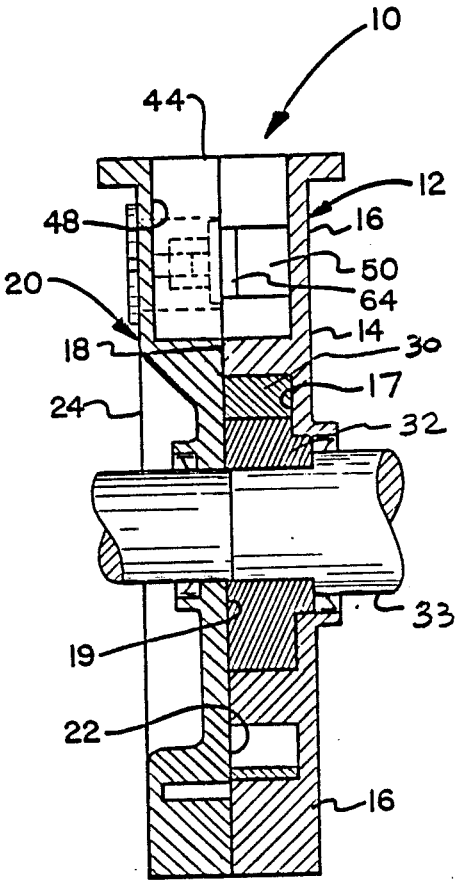
FIG. 2 is a sectioned elevation view of the lube pump viewed through line 2—2 in FIG. 1.

A valve arrangement is located in valve cavity 52, comprising a valve 54, and means, such as a coil spring 56, for biasing the valve toward the open end of the cavity 52, thereby isolating the bypass channel 50 from the valve cavity 52 and inlet conduit 46. Preferably, a pilot member 58 is located in the valve cavity to maintain the valve centered within the cavity. One or more orifices 51 or the like communicate with the pilot bore within tubular stem 71 of valve 54, and prevents a dash pot effect due to hydraulic lock on the valve upon opening or closing rapidly as dictated by the pumping pressure. The wall of bypass channel 50 includes a rim 64 or the like defining an aperture in juxtaposed alignment with the valve cavity 52, so that the valve 54 is biased against the rim to define the closed valve position. As shown in FIG. 2, a portion of the rim 64 is formed as a lip. Rim 64 can be provided by tunneling from bypass conduit 50 to valve feed pocket 72 or by a separate ring (not shown) creating a bridge and tunnel. The pump frame members in accordance with the present invention can be cast with the pilot member 58 integrally formed as a projection from a solid rear wall 24 of frame member 20. FIG. 3 shows pilot 58 projecting from removable cover plate 53, but this illustrated feature is optional.

A relief orifice 66 is formed between the inlet conduit 46 and the valve cavity 52 so that the valve cavity 52 and inlet conduit 46 are continuously in fluid communication. The biased valve 54, however, normally maintains the inlet conduit 46 and valve cavity 52 fluidly isolated from the bypass channel 50 and the outlet conduit 48. As the pressure rises in the outlet conduit 48, the differential pressure between the inlet conduit 46 and the conduit 48 causes the valve spring to be overcome and pressure relief of the outlet conduit 48 is accomplished by fluid flow from the outlet conduit, through the bypass channel 50, valve cavity 52, and relief orifice 66, into the inlet conduit 46.

More particularly, as soon as the pressure in pocket 72 (as exerted by pressure in conduit 50 from conduit 48) is greater than the biasing spring force combined with the pressure in conduit 46 holding valve 54 closed, the valve opens. Immediately the pressure of the fluid in pocket 72 is free to exert itself on the total area of the flat valve head 74, increasing the force against biasing spring 56. The valve opens more and remains open until the pressure in pocket 72 is less than it was to open the valve. This prevents valve oscillation from open to closed to open, i.e., hammering, due to slight fluctuation in pressure (pressure pulses) generated by the pump mechanism.

Thus, the total cross-sectional areas of the valve head 74 and opening 60 of cavity 52 are each greater than the cross-sectional area of the opposed opening of pocket 72 defined by the rim 64 or ring (not shown).

Unlike the sliding piston or poppet value arrangements in the prior art, the valve of the present invention opens more quickly once the threshold pressure differential is reached. In addition, there is no requirement for precise location, dimensioning, and sealing of a bore for the sliding piston, poppet or for the associated valve seat.

Thus, it may be appreciated that the invention as described herein accomplishes the objectives of providing a passively actuated relief valve on a lube oil pump, which is easily fabricated, has few moving parts, and, preferably, no external closing or sealing structure.

We claim:

1. In an oil pump of the type having a split frame with a pump mechanism situated in a chamber formed between the split frames, an inlet conduit extending from an inlet port to the low pressure side of the pump mechanism and an outlet conduit extending from the high pressure side of the pump mechanism to an outlet port, the improvement comprising an excess pressure relief path including:

a bypass channel integrally formed within one frame and fluidly intersecting the outlet conduit; U.S. Ser. No. 319,167 a relief orifice integrally formed in the other frame and situated between the bypass channel and the inlet conduit;

a valve cavity integrally formed within said other frame and fluidly connected between the bypass channel and the relief orifice such that the pressure relief flow path includes said valve cavity; and valve means situated within aid valve cavity, for isolating the bypass channel from the inlet conduit during normal pressure differences between the inlet and outlet conduits, but passively initiating fluid flow from the bypass channel to the inlet conduit when the outlet conduit pressure exceeds the inlet conduit pressure by a predetermined difference.

2. The oil pump of claim 1, wherein the valve means includes a valve member having a substantially flat head and means for biasing the valve member head into contact against a flat portion of the one frame to close the bypass channel.

3. The oil pump of claim 2, wherein the bypass channel includes a fluid pocket having a pocket opening defined by a rim in the one frame;

the valve cavity has a cavity opening in the other frame in confronting relation with the pocket opening, the cavity opening having a larger cross-sectional area than the pocket opening; and the head of the valve member has a cross-sectional area larger than the pocket opening area but smaller than the cavity opening cross-sectional area.

4. A lube oil pump comprising:

a first frame member having a front face, a substantially solid first end portion, and a cut out rear face;

a second frame member having a front face, a rear face, and a substantially solid second end portion, the front face of the second frame member sealingly engaging the rear face of the first frame member, whereby said cut out defines a pump chamber between the frame members and said end portions have respective first and second surfaces in juxtaposed sealed relation; U.S. Ser. No. 319,167 a pump mechanism situated within the pump chamber, having a first configuration in use defining a low pressure pocket and a second configuration in use defining a high pressure pocket;

an inlet conduit leading from one of said end portions through both of said frame members into said low pressure pocket;

an outlet conduit leading from said high pressure pocket through both of said frame members to said one end portion;

a bypass channel integrally formed as a cut out in said juxtaposed surface in the other of said end portions, in fluid communication with the outlet conduit;

a valve cavity integrally formed within said first end portion adjacent said inlet conduit, the valve cavity being in fluid communication with the bypass channel and the inlet conduit;

valve means seated within the valve cavity and biased against the other end portion to close the cavity from the bypass channel unless the fluid pressure in the bypass channel exceeds a threshold pressure, whereupon the valve means opens and relieves the bypass channel pressure into said inlet conduit.

5. The oil pump of claim 4, wherein the inlet and outlet conduits are oriented substantially parallel to each other, and the bypass channel is oriented substantially transversely to the conduits.

6. The oil pump of claim 4, wherein the bypass channel includes rim means defining an aperture in juxtaposed alignment with the valve cavity, and wherein said valve means is biased against said rim means when the valve means is in the closed position.

* * * * *

UNITED STATES PATENT AND TRADEMARK OFFICE

CERTIFICATE OF CORRECTION

PATENT NO. : 4,971,528

DATED : November 20, 1990

INVENTOR(S) : David H. Hodgkins et al

It is certified that error appears in the above-identified patent and that said Letters Patent is hereby corrected as shown below:

Column 4, lines 10 and 11 of Claim 1, delete "U.S. Ser. No. 319,167" .

Column 4, line 19 of Claim 1, "aid" should be --said-- .

Column 5, line 11 of Claim 4, delete "U.S. Ser. No. 319,167" .

Signed and Sealed this

Twentieth Day of April, 1993

*Attest:*

MICHAEL K. KIRK

*Attesting Officer*

*Acting Commissioner of Patents and Trademarks*